United States Patent [19]

Alaze et al.

[11] Patent Number: 4,792,287

[45] Date of Patent: Dec. 20, 1988

[54] WOBBLE DRIVEN AXIAL PISTON PUMP

[75] Inventors: Norbert Alaze, Schwieberdingen; Heinz Leiber, Oberriexingen, both of Fed. Rep. of Germany

[73] Assignee: Robert Bosch GmbH, Stuttgart, Fed. Rep. of Germany

[21] Appl. No.: 62,976

[22] Filed: Jun. 17, 1987

[30] Foreign Application Priority Data

Sep. 16, 1986 [DE] Fed. Rep. of Germany ..... 3631408

[51] Int. Cl.[4] ..... F04B 1/14; F04B 35/04; F04B 39/08

[52] U.S. Cl. ..... 417/269; 417/271; 417/515

[58] Field of Search ..... 417/269 E, 271, 515, 417/454; 91/480, 481

[56] References Cited

U.S. PATENT DOCUMENTS

| | | | |
|---|---|---|---|
| 1,364,508 | 1/1921 | Moody | 417/269 |
| 2,138,194 | 11/1938 | Pfauser | 417/575 |
| 2,689,532 | 9/1954 | Orshansky Jr. | 91/481 |
| 2,785,639 | 3/1957 | Huber | 91/480 |
| 3,067,694 | 12/1962 | Faucher | 417/269 |
| 3,209,701 | 10/1965 | Phinney | 417/269 |
| 3,627,451 | 12/1971 | Kours | 417/271 |
| 3,741,076 | 6/1973 | Tulp | 91/480 |
| 3,746,476 | 7/1973 | Bradley | 417/269 |
| 3,772,965 | 11/1973 | Kita | 91/480 |
| 4,396,357 | 8/1983 | Hartley | 417/269 |
| 4,445,825 | 5/1984 | Budecker | 417/462 |
| 4,555,223 | 11/1985 | Budecker | 417/462 |

FOREIGN PATENT DOCUMENTS

| | | | |
|---|---|---|---|
| 957900 | 1/1957 | Fed. Rep. of Germany | 417/269 |
| 3440850 | 5/1986 | Fed. Rep. of Germany | 417/269 |
| 960057 | 6/1964 | United Kingdom | 417/269 |
| 2126666 | 3/1984 | United Kingdom | 417/454 |

*Primary Examiner*—William L. Freeh
*Attorney, Agent, or Firm*—Edwin E. Greigg

[57] ABSTRACT

An axial piston pump for pumping a medium such as a viscous liquid in which a wobble element is set into rotating movement via a piston, the wobble element moving at least one feed piston in a piston bore. The piston bore is intended to communicate, via a transverse line and a further piston bore which is occupied by a control piston, with an intake line for the medium to be pumped. By means of this axial piston pump, which is valve-controlled on the compression side and slide-controlled on the intake side, liquid having a high viscosity can be pumped without a loss of efficiency, and any noise produced by the pump can be reduced. These latter advantages are reinforced still further provided the feed system is received in a pump insert that is supported with respect to a pump housing by means of elastic bearing elements.

16 Claims, 4 Drawing Sheets

WOBBLE DRIVEN AXIAL PISTON PUMP

BACKGROUND OF THE INVENTION

The invention relates to a cam driven axial piston pump. An axial piston pump of this kind is disclosed, for instance in international application No. WO 84/00403. In the axial piston pump shown there, a plurality of pistons distributed on a circular arc, which by means of a shared drive element, disposed on a drive shaft oriented axially parallel with the piston axes and executing a tumbling movement, can be pressed into cylindrical bores and returned again under spring loading. A medium to be pumped is aspirated by lifting a valve off its valve seat upon retraction of the piston, but upon movement of the piston in the opposite direction the valve is closed, and the medium to be pumped is expelled via another valve. Feed lines equipped with valves in this manner are not suitable for transporting fluid having an elevated viscosity, for instance fluid having a viscosity up to 1,500 $mm^2/s$. With fluids of such viscosity, valve seats cannot be closed fast enough, resulting in considerable disruptions in the pumping process.

Known axial piston pumps also have the disadvantage of generating considerable noise.

Known axial pistons are also very compactly built, as a rule, and the wobbling element is typically firmly attached to the motor shaft. The same applies to the connection of the pump or pump housing with the pole housing of the motor. If wear of individual parts, such as the wobbling element, occurs, the entire apparatus becomes unusable. Individual parts cannot be replaced.

OBJECT AND SUMMARY Of THE INVENTION

The axial piston pump of this invention has an advantage over the prior art in that a fluid having a relatively high viscosity can be pumped; the volumetric efficiency of the pump may be somewhat restricted, but its function is nevertheless assured. There are no valve elements, which have functional problems when the fluid to be pumped has a relatively high viscosity, anywhere in the entire feed line. The present axial piston pump is valve-controlled on the compression side and slide-controlled on the intake side. This slide comprises a control piston, while a simple ball valve is provided as the control valve.

The individual control edges, which both the feed piston and the control piston run up to, are essential. After passing through a top dead center, the feed piston generates a negative pressure in a pressure chamber located between a transverse line and the ball valve. At the transition from the pressure chamber to the transverse line, the feed piston overtakes a control edge, which causes the negative pressure generated in the pressure chamber to be propagated in the transverse line and in the intake line, the intake line being opened by the control piston.

With movement in the opposite direction, the control piston first closes the intake line when a further control edge is overtaken, and only then does the operation of the feed piston begin. As a result, a low pressure increase gradient in the line system is attained, leading to an abatement of the noise produced. In the further course of the feed piston, this control edge is overtaken. This reduces the idle space behind the feed piston. It thus becomes possible to compress any trapped air bubbles to such an extent that they can be expelled via the outlet valve embodied as a ball valve. Pumps controlled by an intake slit can be considered as an example of the opposite situation in terms of noise production.

Thus an axial piston pump of this kind not only responds to the need for pumping fluids of high viscosity, but also that of performing such pumping with as little noise as possible.

An object of easier handling and/or of a possibility of replacement of individual parts of the axial piston pump is attained particularly if the tumbling element and the feed piston are located in a pump insert that is surrounded by a pump housing. To reduce noise, care is taken to provide bearing elements between the pump insert and the pump housing. The pump insert is thereby supported in the pump housing in such a manner as to preclude structure-borne sound. On the other hand, the entire zone in which operation under pressure takes place remains in the pump insert; the pump housing itself need not withstand any pressure and can therefore be made of plastic material, which contributes further to noise abatement and also has advantages in terms of cost.

Within the scope of the invention, there is provided a pump housing having a connection nipple, with an annular chamber being formed by plastic bearing elements disposed on both sides of the connection nipple. This annular chamber then communicates via perforations in the pump insert with an annular groove, by way of which the medium to be pumped can be transported to the feed piston via a further line.

The entire pump insert is retained axially and radially in a simple manner by means of a cap, which is connected to the pump housing.

Particular advantages are naturally attained if a slide-controlled inlet valve is located beside a feed piston in a pump insert.

It is also provided that a deep groove ball bearing serves as the wobble element, and the feed and control pistons run on the outer race of the bearing. This is a cost-effective provision, because the deep groove balls are mass-produced.

According to the invention, the contact retention of the pistons with the wobble element during piston retraction is effected via a spring-supported pressure washer.

For the connection between the engine drive shaft and the wobble element, or the shaft end supporting the wobble element, a rounded hexagon is provided that engages the drive shaft from the inside on one end and engages the shaft end from the inside on the other. This hexagon has the advantage that to a certain extent it allows axial and radial degrees of freedom, so that errors in alignment between the engine and the pump insert can be compensated for.

It is also very easy to remove the pump insert from the pump housing, for instance when the tumbling element becomes worn, and replace it with a new one.

Since, according to the invention, the pump housing is made of plastic for the sake of noise abatement and the pole housing of the motor is of metal, the different coefficients of thermal expansion can lead to strains between the pump housing and the pole housing during operation of the axial piston pump; that is, if the bearing face of the pole housing and housing and that of brackets resting on a retaining plate are not located in the same plane. It is therefore provided here that the pole housing of the motor be connected firmly to the pump housing; the connection point is located on a line at right angles to the center line of the pump, which is effected by means of brackets that are fixed to the pole housing and that grip a retaining plate attached to the pump housing from behind. These brackets effect a pre-stressing that absorbs the variable thermal expansion that may still arise.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
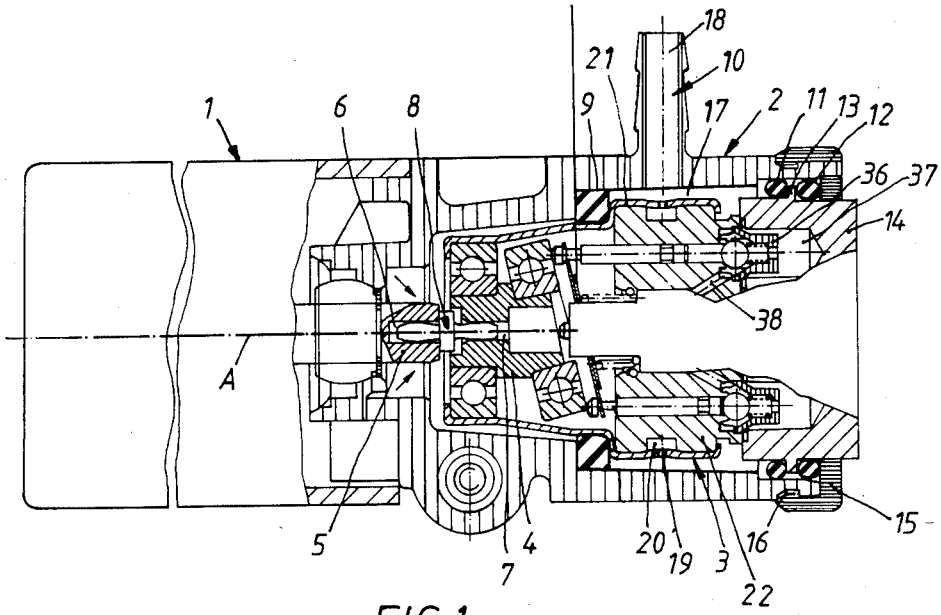
FIG. 1 is a fragmentary longitudinal section taken through an axial piston pump according to the invention.

An axial piston pump as shown in FIG. 1 comprises a motor to which a pump housing 2 including a pump insert 3 therein is connected. A shaft end 4 of the pump insert 3 is oriented with respect to an output shaft 5 of the motor 1 such that a blind bore 6 in the output shaft 5 is located on an axis of rotation A with a bore 7 in the shaft end 4. A connecting element 8 shown in greater detail in FIG. 6 engages the blind bore 6 from the inside, on one end, and engages the bore 7 from the inside on the other end, and couples the output shaft 5 to the shaft end 4.

The pump insert 3 is supported with respect to the pump housing 2 by plastic bearing elements 5'. An approximately square annular bead 9 is provided within the housing on one side of a connection nipple 10 in the pump housing 2. A further elastic element comprises a rubber ring 11 disposed on the other side of the connection nipple 10. A further rubber ring 12 effects sealing off from the outside. The rubber rings 11 and 12 between them retain an annular dog or flange 13, which is formed protruding from a head portion 14 of the pump insert 3.

An axial and radial retention of the pump insert is effected by means of a cap 15, which is locked in detent fashion onto the pump housing via an undercut 16. The rubber ring 12 is included between the cap 15 and the annular dog 13.

The square annular head 9 and the rubber ring 11 form a closed annular chamber 17 between the pump housing 2 and the pump insert 3 which communicates on the one hand with the inner bore 18 of the connection nipple 10 and on the other, via perforations 19 in an outer shell 21 of the pump insert 3, with an annular groove 20 in an insert part 22.

Figure 2:
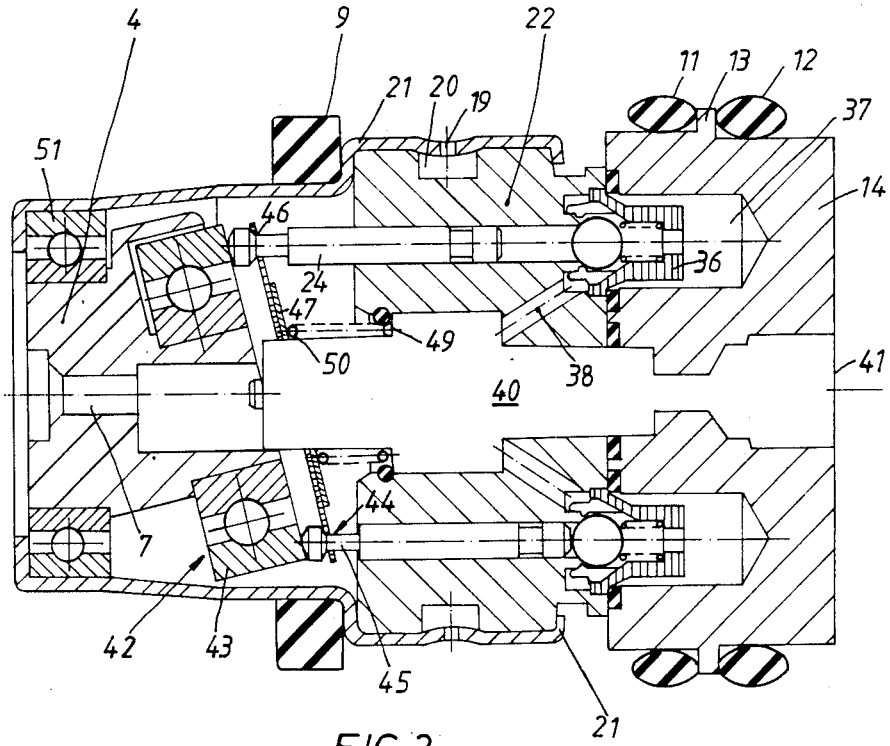
FIG. 2 is a longitudinal section, on a larger scale, through a pump insert.

Provided in the insert part 22 are control and feed pistons for the medium to be pumped, of which only the feed pistons 24 are shown in FIGS. 1 and 2. The corresponding control pistons connected to the feed pistons 24 are located offset by 90° in the insert part 22.

Figure 3:
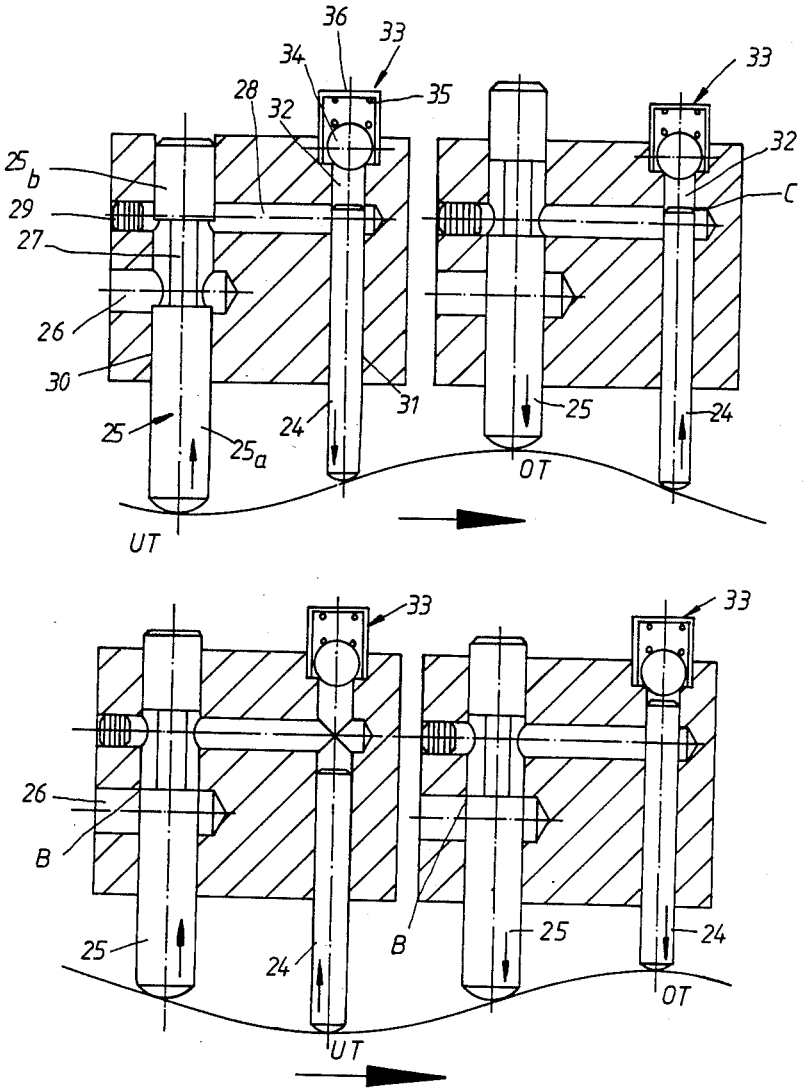
FIG. 3 is a progressive diagram illustrating the control principle of the axial piston pump of FIG. 1.

The connection between the control pistons 25 and feed pistons 24 can be found in FIG. 3. Both pistons 25 and 24 run in corresponding axially parallel piston bores 30 and 31, respectively, in the insert part 22.

The piston bore 30 of the control piston 25 intersects both a radially extending intake line 26 and a transverse line 28 crossed by the piston bore 31. The intake line 26 also adjoins the annular groove 20, while the transverse line 28 is closed off from the outside by a stopper 29.

While the piston bore 31 has a diameter that corresponds to that of the feed piston 24, the control piston has a slide portion 25*a*, which corresponds to the diameter of the piston bore 30 but serves merely to close the intake line 26 and results in a pressure-balanced control slide.

This slide portion 25*a* is then connected to a piston head 25*b* via a bolt element 27 having a diameter smaller than the piston bore 30.

The piston bore 31 crosses the transverse line 28 first and then continues in a pressure chamber 32, which is closed off by a ball valve 33. The ball 34 and spring 35 are seated in a housing 36, which as shown in FIG. 1 is received by a blind bore 37 in the head portion 14. An oblique line 38 branches off from this ball valve 33 in the direction of the axis of rotation A and there discharges into an axial chamber 40, which terminates in an outlet 41 for the medium.

The axial chamber 40 is equipped with valve elements, not shown in detail, such as an outlet valve for draining the medium after the axial piston pump is turned off, or an overpressure valve. These parts are not essential to the invention in the present case, however, and so are not shown or described in detail.

Figure 7:
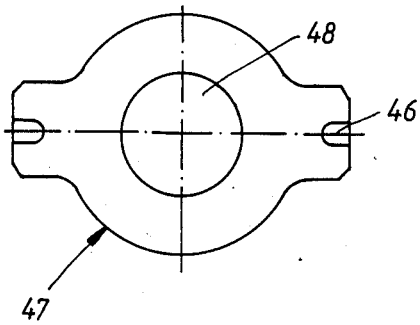
FIG. 7 is a plan view on a pressing spring plate, shown on a larger scale.

The axial motion of the control or feed pistons 24, 25 is generated by a wobble element 42, which comprises two deep groove ball bearings seated on an eccentric shaft end 4. Serving as a bearing face for the pistons 24 or 25 is the outer race 43 of the ball bearing. Toward this outer race 43, the pistons 24 or 25 have a tappet portion 44, the tappet neck 45 of which sits in a fork 46. The fork 45, as shown in FIG. 7, is part of a forked pressure washer 47, and an inner opening 48 receives the axial chamber 40, in the operational position. Since one forked washer 47 each is provided for both the feed pistons 24 and the control pistons 25, two such washers are shown, one resting on top of the other, in FIGS. 1 and 2. A spring 50 is supported between these forked washers 47 and a shoulder 49 formed by the axial chamber 40. This spring 40, in cooperation with the forked washers 47, has the effect of keeping the pistons 24 or 25, or their tappet portions 44, in contact with the outer race 43 during rotation of the wobble element 42.

The shaft end 4 also runs in a further ball bearing 51.

Figure 6:
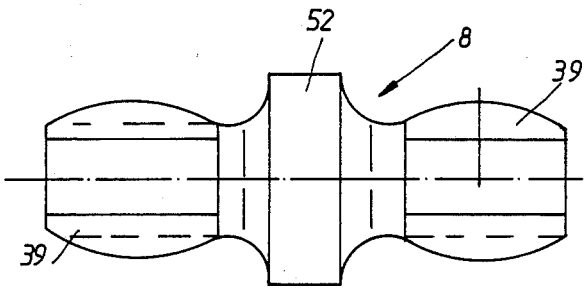
FIG. 6 is a side view of a coupling element between the motor and the pump insert.

Serving as a coupling between the output shaft 5 or armature shaft of the motor 1 and the eccentric shaft end 4 is the connecting element 8, which is shown in FIG. 6. It substantially comprises two rounded hexagons 39 disposed on both sides of a center disk 52, one of the hexagons engaging the inside of the blind bore 6 of the output shaft 5 and the other engaging the bore 7 of the shaft end 4 in a form-locking manner. This form-locking connection has both axial and radial degrees of freedom, however, so that by this means errors in alignment of the pump insert 3 and motor 1 can be compensated for.

Figure 4:
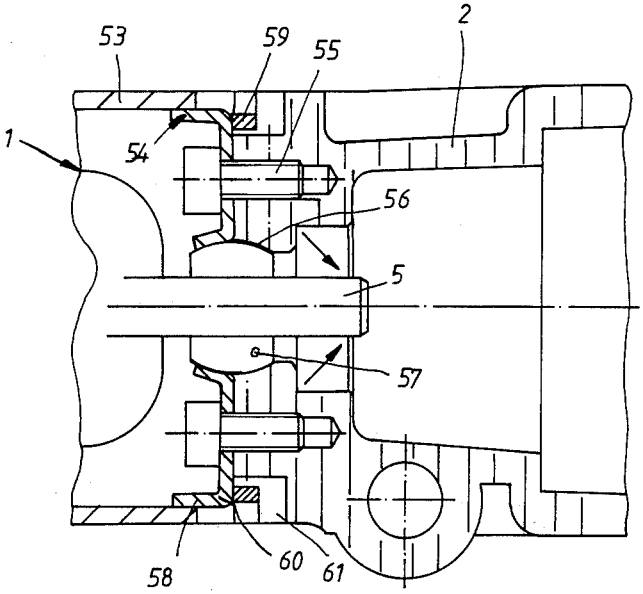
FIG. 4 is a detail, on a larger scale, of a longitudinal section taken through a further exemplary embodiment of an axial piston pump in the vicinity of the transition from the motor to the pump.
Figure 5:
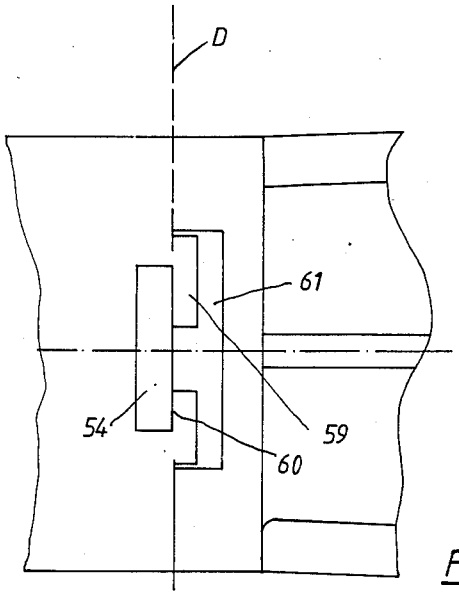
FIG. 5 is a view of FIG. 4 seen from the outside.

The fastening between a pole housing 53 of the motor 1 and the pump housing 2 is embodied as shown in FIGS. 4 and 5. On the face end side, a retaining plate 54 is mounted on the pump housing 2 by means of screw bolts 55; together with recesses on the face end of the pump housing, the retaining plate 54 forms a shell 56 for receiving a bearing 57 on the output shaft 5. The outer rim 58 of the retaining plate 54 is raised to form a peripheral collar, so that the complete retaining plate has a U-shaped cross section. This outer rim 58 is pushed into the pole housing 53 until the bearing of the pump housing 2 and the pole housing 53 rest flush on one another.

For joining the two housings to one another, the pole housing 53 has brackets 59, which when the two housings are assembled are bent downward via an incline 60 on the retaining plate 54 into a recess 61 in the pump housing 2. To a certain extent, this effects a pre-stressing between the housings to be connected. In this way, a loosening of the connection between the pole housing 53 and the pump housing 2 under thermal strain, for example as a consequence of different coefficients of thermal expansion, is avoided. The essential feature here is that the bearing face of the bracket 59 and retaining plate 54 and the bearing face of the pole housing 53 and the housing 2 are located in a plane D, which is disposed at right angles to the center line or axis of rotation A of the pump. This advantage is particularly important when the pump housing 2 is of plastic as provided by the invention and the pole housing 53 is for instance of steel.

This axial piston pump according to the invention functions as follows, as shown in FIG. 3:

In FIG. 3, the position I shown at top left is that in which the control piston 25 is at bottom dead center. The intake line 26 is opened. The feed piston 24 is located between its top dead center and its bottom dead center and is moving toward its bottom dead center. Shortly before as well as after this position I, the medium to be pumped is already being aspirated through the intake line 26, because a continuous volume increase in the line system is occurring, and moreover this system moreover closed off on the outlet side by either the feed piston 24 or the ball valve 33.

The next position II that the system attains is shown at bottom left in FIG. 3. The control piston is approaching its top dead center, and in the position II shown it closes the control edge B and thus the intake line 26. The feed piston 24, contrarily, is located at its bottom dead center.

If the wobble element 42 is now rotated further, then a compression of the trapped medium takes place. As soon as the compression exceeds the counter-pressure of the ball valve, the medium is expelled through the ball valve, enters the oblique line 38 and the axial chamber 40, and from there enters the outlet 41. As a result of these movement events thus shown, a slow pressure rise also takes place, corresponding to a sine function, because the speed of the feed piston in the vicinity of the bottom dead center is approximately equal to zero.

In the position III shown at top right in FIG. 3, the control piston 25 has attained its top dead center; the intake line 26, as before, is still closed. The feed piston 24 likewise moves toward its top dead center and in so doing reaches the control edge C, at which the pressure chamber 32 below the ball valve 33 is closed. If air should for instance have been aspirated along with a liquid medium, then this air can be compressed in the pressure chamber 32 and expelled.

The next position IV is shown at bottom right in FIG. 3. Here the control piston 25 is moving back toward its bottom dead center and has just reached the control edge B to the intake line 26. The feed piston is located at its top dead center and then moves toward its bottom dead center again. Upon the retraction of the feed piston 24, a negative pressure is generated in the pressure chamber 32 below the ball valve 33, and after the control edge C is overtaken by the feed piston 24 this negative pressure leads to an aspiration of the medium to be pumped. The cycle then begins over again from the beginning.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An axial piston pump which is driven by a motor for pumping a viscous medium, comprising a wobble element (42) which is set into rotation via said motor, at least one feed piston (24), in a first piston bore (31), at least one control piston (25) in a second piston bore (30), said at least one feed piston and said at least one control piston being offset by substantially 90° from a related control piston in a circumferential direction with the same radial distance from a linear axis of the wobble element reciprocated by said wobble element, a transverse line (28) that communicates between said first and second piston bore, and which communicates with said first piston bore for feeding a medium to be pumped to said control piston.

2. An axial wobble piston pump as defined by claim 1, in which said piston bore (31), embodies a pressure chamber (32), which is equipped with an outlet valve, downstream from said transverse line (28), said transverse line (28) is spaced from the top dead center of said feed piston (24) such that on its way to top dead center said feed piston overtakes the cross section of said transverse connection with said first piston bore seal off said transverse connection.

3. An axial wobble piston pump as defined by claim 2, in which said feed piston (24), during movement toward said valve produces a pressure buildup in pressure chamber (32) up to top dead center and after passing through top dead center (OT), generates a negative pressure in the pressure chamber (32), which after said feed piston (24) has passed a control edge (C) in said transverse line (28) which opens said pressure chamber (32) toward the transverse line (28) causes an aspiration of said viscous medium to be pumped, and at this instant said control piston (25) overtakes a control edge (B) and of said intake line (26).

4. An axial wobble piston pump as defined by claim 3, in which after passing through a bottom dead center, said control piston (25) again moves toward said control edge (B) and closes said intake line (26), at which instant said feed piston (24) is located at its bottom dead center.

5. An axial wobble piston pump as defined by claim 1, in which said wobble element includes an outer race (43) of a deep groove ball bearing and said feed piston (24) and said control piston (25) run on said outer race (43) of said deep groove ball bearing.

6. An axial wobble piston pump as defined by claim 5, which includes at least two control pistons (25) and at least two feed pistons (24) located on a circle about a linear axis of said insert with the axis as its center, and a line that communicates between adjacent control pistons and feed pistons, said at least two control pistons and said at least two feed pistons being retained in contact with said wobble element (42) by separate thin leaf-like spring pressure washers (47) having forks (46) that engage said control pistons and said feed pistons to force said control pistons and said feed pistons against said wobble element.

7. An axial wobble piston pump which is driven by a motor for pumping a viscous medium, which comprises a wobble element (42) which is set into rotation via said motor, said wobble element drives at least one feed piston in a piston bore, said wobble element (42) and said at least one feed piston (24) being located in a pump insert (3), which is surrounded by and spaced from a pump housing (2), in which elastic sealing elements (9, 11, 12) are located between said pump insert (3) and said pump housing (2) to elastically support said pump insert radially and axially, and said pump insert (3) is retained axially and radially by a cap (15), which is locked in detent fashion in an undercut (16) of said pump housing (2).

8. An axial wobble piston pump as defined by claim 1, in which said wobble element (42) is supported by a shaft end (4) of said insert (3), said motor includes an output shaft (5), said output shaft (5) of said motor (1) is coupled via said connecting element (8) with a shaft end (4) supporting the tumbling element (42), said connecting element engages the inside of a blind bore (6) of the output shaft (5) on one end and on the other end engages the inside of a bore (7) in the shaft end (4).

9. An axial wobble piston pump as defined by claim 7, in which said pump housing (2) forms an outer housing which is firmly connected to a pole housing (53) of said motor (1) at one end and in which said pump insert (3) is elastically, floatingly received from one end of said pump housing.

10. An axial wobble piston pump which is driven by a motor for pumping a viscous medium, which comprises a wobble element (42) which is set into rotation via said motor, said wobble element drives at least one feed piston in a piston bore, said wobble element (42) and said at least one feed piston (24) being located in a pump insert (3), which is surrounded by and spaced from a pump housing (2), in which elastic sealing elements (9, 11, 12) are located between said pump insert (3) and said pump housing (2) to elastically support said pump insert radially and axially, said wobble element (42) is supported by a shaft end (4) of said insert (3), said motor includes an output shaft (5), said output shaft (5) of said motor (1) is coupled via a connecting element (8) with said shaft end (4) supporting said wobble element (42), said connecting element engages the inside of a blind bore (6) of the output shaft (5) on one end and on the other end engages the inside of a bore (7) in the shaft end (4).

11. An axial wobble piston pump as defined by claim 10, in which said pump housing (2) is firmly connected to a pole housing (53) of said motor (1).

12. An axial wobble piston pump for pumping a viscous medium which comprises a pump housing (2) including a retaining plate (54) mounted on said pump housing toward a face end, said retaining plate (54) includes an outer rim (58) that has an incline (60), a pump insert (3) secured within said housing (2), a pole housing in axial alignment with said pump housing, a motor secured within said pole housing, said pole housing includes an inner rim, and brackets (59) which originate at said pole housing by which said pump housing may be firmly connected to said pole housing of said motor, a wobble element (42) supported by a shaft end (4) of said insert (3) which is set into rotation via an output shaft (5) of said motor, said output shaft (5) of said motor (1) is coupled via a connecting element (8) with said shaft end (4) supporting said wobble element (42), said connecting element engages the inside of a blind bore (6) of the output shaft (5) on one end and on the other end engages the inside of a bore (7) in the shaft end (4), said wobble element drives at least one feed piston in a piston bore, said wobble element (42) and said at least one feed piston (24) being located in said pump insert (3), which is surrounded by said pump housing (2).

13. An axial wobble piston pump as defined by claim 12, in which said retaining plate (54) faces said outer rim (58), and together with a recess in said pump housing embodies a shell (56) for receiving a bearing (57) for said output shaft (5).

14. An axial wobble piston pump which is driven by a motor for pumping a viscous medium, which comprises a wobble element (42) which is set into rotation via said motor, said wobble element drives at least one feed piston in a piston bore, said wobble element (42) and said at least one feed piston (24) being located in a pump insert (3), which is surrounded by and spaced from a pump housing (2), in which elastic sealing elements (9, 11, 12) are located between said pump insert (3) and said pump housing (2) to elastically support said pump insert radially and axially, said sealing element (9) is an elastic bead on one side of a pump inlet including a connection nipple (10) located on said pump housing, and said sealing element (11) is a rubber ring (11) which extends on another side of said connection nipple and an annular chamber (17) being formed between said bead (9) and said ring (11), said pump inlet includes said annular chamber (17), an outer shell (21) surrounding said pump insert, and perforations (19) in said outer shell in the vicinity of said annular chamber (17), said perforations (19) connecting said annular chamber (17) with an annular groove (20), by way of which said medium can be carried to a control piston (25).

15. An axial wobble piston pump which is driven by a motor for pumping a viscous medium, which comprises a pole housing for said motor, a wobble element (42) which is set into rotation via said motor, said wobble element drives at least one feed piston in a piston bore, said wobble element (42) and said at least one feed piston (24) being located in a pump insert (3), which is surrounded by and spaced from a pump housing (2), said pump housing (2) is firmly secured to said pole housing, said insert (3) is spaced from said pump housing (2) by elastic sealing elements (9, 11, 12) so that said insert and said wobble element are elastically movable relative to an axis of said motor to keep vibration of said insert away from said motor and said pole housing, and said wobble element includes an outer race (43) of a deep groove ball bearing and said feed piston (24) and a control piston (25) run on said outer race (43) of said deep groove ball bearing.

16. An axial wobble piston pump as set forth in claim 1 which includes two oppositely disposed control pistons and two oppositely disposed feed pistons located on a circle about a linear axis of said insert with said axis as its center.

* * * * *